US010458740B2

(12) United States Patent
Hines

(10) Patent No.: US 10,458,740 B2
(45) Date of Patent: Oct. 29, 2019

(54) MODULAR ARMORERS STAND

(71) Applicant: Falcon Industries, Inc., Moriarty, NM (US)

(72) Inventor: Stephen Charles Hines, Edgewood, NM (US)

(73) Assignee: Falcon Industries, Inc., Edgewood, NM (US)

( * ) Notice: Subject to any disclaimer, the term of this patent is extended or adjusted under 35 U.S.C. 154(b) by 0 days.

(21) Appl. No.: 16/132,057

(22) Filed: Sep. 14, 2018

(65) Prior Publication Data

US 2019/0086178 A1 Mar. 21, 2019

Related U.S. Application Data

(60) Provisional application No. 62/559,062, filed on Sep. 15, 2017.

(51) Int. Cl.
*F41A 23/18* (2006.01)

(52) U.S. Cl.
CPC ..... *F41A 23/18* (2013.01)

(58) Field of Classification Search
CPC ..... F41A 23/18; F41C 27/00; A47B 81/005
See application file for complete search history.

(56) References Cited

U.S. PATENT DOCUMENTS

| | | | | |
|---|---|---|---|---|
| 7,690,606 | B1 * | 4/2010 | Batdorf | B25B 1/22 248/181.1 |
| 9,228,800 | B2 | 1/2016 | Holmes et al. | |
| 2014/0182184 | A1 * | 7/2014 | Gianladis | F41A 23/18 42/94 |
| 2019/0072356 | A1 * | 3/2019 | Couie | F41A 23/18 |
| 2019/0162499 | A1 * | 5/2019 | Jacobson | F41A 23/18 |

* cited by examiner

*Primary Examiner* — J. Woodrow Eldred
(74) *Attorney, Agent, or Firm* — Richard H. Krukar; Kermit D. Lopez; Luis M. Ortiz

(57) ABSTRACT

A modular armorer's stand has a block that, on one end, can engage the magazine well of a firearm frame. The other end of the block has a tongue that can be slid into a base. The base can be mounted to a surface such as a work bench. As such, the frame is held solidly in place for gunsmithing. The firearm's magazine release can engage a notch in the block. Each block can be sized specifically for a certain firearm or firearm family while every block has a tongue that can be held by the base. An armorer therefore needs a single solidly mounted base and that base can hold various blocks that, in turn, hold various firearms.

20 Claims, 7 Drawing Sheets

MODULAR ARMORERS STAND

RELATED APPLICATIONS

This application claims the benefit and priority of U.S. Provisional Application 62/559,062 filed Sep. 15, 2017 and titled "Modular Armorers Stand." U.S. Provisional Application 62/559,062 is herein incorporated by reference in its entirety.

FIELD OF THE INVENTION

Embodiments are related to firearm armorer's blocks, to magazine posts, to gunsmithing, and to semiautomatic handguns.

BACKGROUND

Armorers and gunsmiths are people whose duties include repairing and configuring firearms. One class of tools that have been commonly used is armorer's blocks and magazine posts. Armorer's blocks, also called bench blocks, are typically items that can be laid on a bench and have cavities, openings, slots, and holes that ease various tasks such as driving pins into and out of a firearm or steadying a workpiece. Armorers and gunsmiths typically have and use a variety of armorers block in their day-today labors. Armorers and gunsmiths working on semiautomatic firearms also use magazine posts.

Magazine posts are posts that can hold a semiautomatic firearm. For example, a bench vise can hold the bottom portion of a magazine post while the top portion of the magazine post is in the magazine well of a semiautomatic firearm. One popular magazine post is configured to slide into the magazine well of an AR-15/M-4 style rifle/carbine and to engage the magazine release mechanism. The lower portion of the AR-15/M-4 magazine post can be clamped in a vise to solidly hold the firearm's lower receiver in a fixed position.

Magazine posts and armorer's blocks are prized tools in a gunsmith's toolbox because they significantly improve a person's ability to work on a firearm. The currently available tools, however, are not ideal for many modern day semiautomatic handguns or for modern day workbenches. Systems and methods for fixedly holding modern day semiautomatic handguns are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is therefore an aspect of the embodiments that a block having a well engagement and a tongue can hold a firearm having a magazine well. In general, a firearm having a frame with a magazine well can be loaded by sliding a magazine holding ammunition into the magazine well. The well engagement can be sized similarly to a magazine for a particular firearm such that it can slide into the magazine well in the same manner as a magazine. The tongue can be securely held such that a firearm slid onto the well engagement is also securely held. The frame block can have a notch that engages a magazine release in the frame to thereby lock the well engagement in the magazine well in the same manner as a magazine would be locked into the frame by the magazine release. When installed in a frame having slide rails, the well engagement can have a top flat that is angled such that the top flat lies parallel to the slide rails.

It is a further aspect of the embodiments that the blocks tongue can be slid into a base. The base can have a base bottom, a stand, and a slot. The base is configured such that the base can be attached to a flat surface. For purposes of this non-limiting description, it is assumed that surface is horizontal and that the base is attached to the top of the flat surface. The stand extends upward from the base and the slot extends from the top of the stand and down into the stand. The tongue can be slid into the slot such that the block is held by the base. The block can have a low flat at the bottom of the well engagement that prevents well engagement from sliding into the slot. The tongue extends down from the well engagement and into the slot. The slot is sized such that that the tongue slides into the slot and the magazine engagement does not slide into the slot. The slot can have ribs wherein the slot and ribs are sized and configured such that that the tongue slides into the slot and the magazine engagement does not. Plastic blocks and bases are anticipated with mold artifacts on the plastic parts.

It is a still further aspect of the embodiments that the same base can hold blocks configured for differently sized frames and magazine wells. The blocks can have similarly sized tongues but differently sized well engagements. The differently sized well engagements can slide into differently sized magazine wells, be releasably held by the magazine releases of the differently sized firearm frames. For example, in addition to the first block described above, a second block can be sized for holding a second frame of a second firearm having a second magazine well and a second magazine release. The second block has a second well engagement, a second notch, and a second tongue. The second well engagement and second notch are sized and configured to slide into the second magazine well and to releasably engage the second magazine release such that the second frame is secured to the second block. The second tongue is sized and configured to slide into the slot of the base. The two magazine wells being sized differently, one of the well engagements will slide into one of the magazine wells but not into the other.

The block can have one or more block mounting holes and the base can also have mounting holes. The block mounting holes and the mounting holes can be sized and positioned such that a pin or bolt can pass through a block mounting hole and properly aligned mounting holes to thereby fix the base to the block when the tongue is in the slot. The base can have base holes for attaching the base to a surface.

A well engagement's top ramp can be sized and configured to prevent small parts from falling between the well engagement and the magazine wells. As is well understood by armorers, firearms often have small parts that can be easily lost. The small parts may be harder to lose when they can't fall between the well engagement and magazine well. The top ramp can be configured such that the top ramp is parallel to the frame's slide rails or to the top of the frame. Similarly, the lower flat can parallel to the top ramp.

As discussed above, the slot can have ribs. The ribs can be sized and configured such that the tongue slideably engages the slot. Furthermore, the block can have cavities separated by walls. Cavities that do not pass completely through the block have cavity bottoms.

Firearm frames can have differently positioned magazine releases such as left side releases or right side releases. The block can therefore have multiple notches with each notch positioned to be engaged by a magazine release in one of the various different positions. As such, the one block can slide into any one of numerous properly sized frames and engage a magazine release even if those numerous frames have magazine releases in different positions.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DESCRIPTION

The particular values and configurations discussed in these non-limiting examples can be varied and are cited merely to illustrate at least one embodiment and are not intended to limit the scope thereof. In general, the figures are not to scale.

Figure 1:
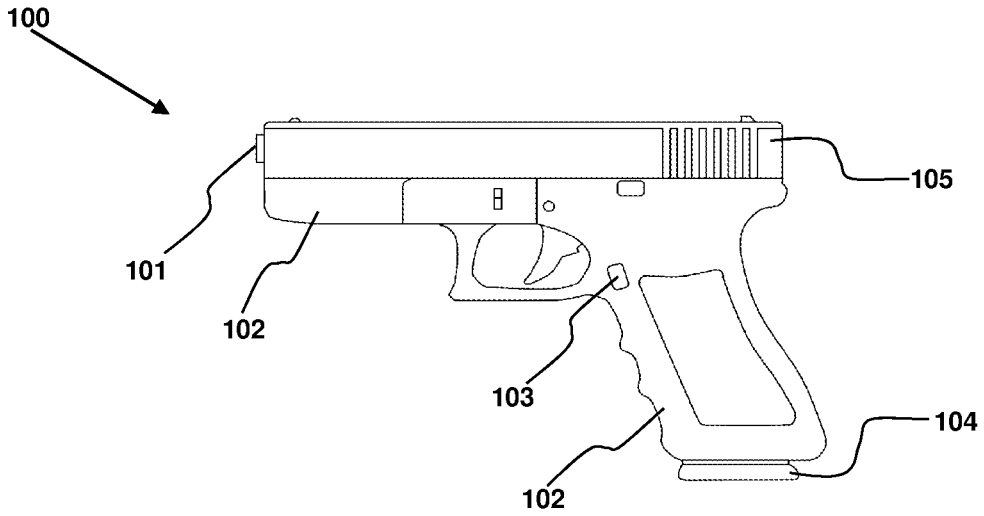
FIG. 1, labeled as "Prior Art," illustrates a semiautomatic handgun.

FIG. 1 illustrates a semiautomatic handgun 100. Those familiar with semiautomatic firearms will immediately recognize the frame 102, slide 105, magazine 104, and barrel 101. The slide 105 is in its locked forward position and can be pulled back such that it slides rearward on the frame 102. The magazine 104 is in the frame's magazine well 201 and is held in place by the magazine release 103. Pressing the magazine release 103 releases the magazine 104 which can then drop out of the frame 102.

Figure 2:
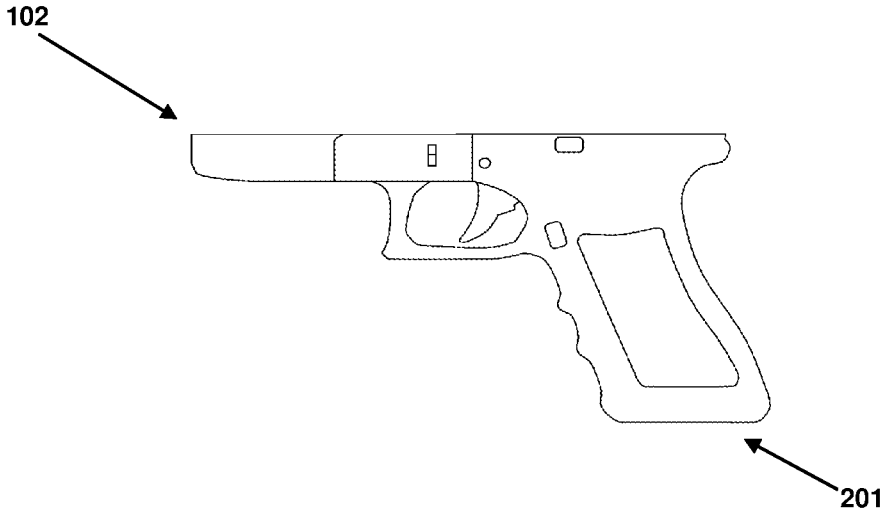
FIG. 2, labeled as "Prior Art," illustrates the frame of the handgun of FIG. 1.

FIG. 2 illustrates the frame 102 of the handgun of FIG. 1. Of particular note regarding the disclosed embodiments are the magazine well and the magazine release (a.k.a. magazine catch). As is notoriously well known by those familiar with semiautomatic firearms 100, a firearm may have a magazine well 201 and a magazine release 103. The magazine well 104 is a cavity in the firearm frame 102 or receiver into which a magazine 104 is installed. The magazine 104 holds rounds that may be automatically fed into the firearm's chamber during operation.

The magazine release 103 is typically a spring loaded actuator that is installed in a firearm's frame 102 or receiver. The spring pushes a portion of the magazine release 103 into the magazine well 201. That portion of the magazine release engages a notch in a firearm magazine 104 to thereby hold the magazine 104 in proper alignment in the magazine well 201. Pressing the magazine release 103 causes that portion to disengage the magazine 104 such that the magazine 104 can be removed from or, ideally, drop free of the firearm 100.

An armorer's stand has a block 300 and, optionally, a base plus additional blocks. The block 300 is sized similar to a magazine 104 such that it fits snugly into the magazine well 201 of a firearm. The block 300 has a release notch 305, similar to the notch in a magazine, such that the magazine release 103 holds the block 300 in the magazine well 201 and such that operating the magazine release 103 frees the block 300 such that the block 300 can slide free of the firearm 100.

Figure 3:
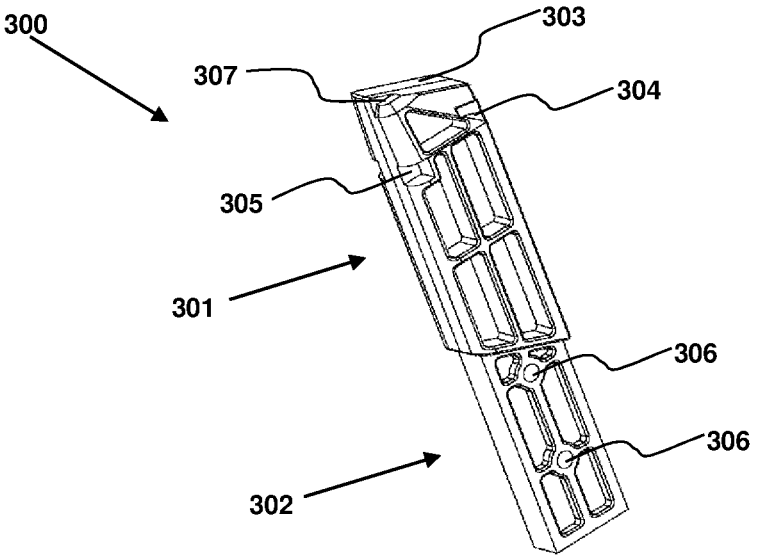
FIG. 3 illustrates a block for an armorer's stand in accordance with aspects of the embodiments.

FIG. 3 illustrates a block 300 for an armorer's stand. The well engagement 301 is the portion that is sized similar to a magazine. The block 300 is sized specifically for a specific firearm model or firearm model family. For example, one firearm model family includes the Glock 17, 19, 22, 23, 24, 26, 27, 31, 32, 33, 34, and 35 (hereinafter the "small frame family"). A second firearm family include the Glock 20, 21, 29, 30, 31, 32, 40, and 41 (hereinafter the "large frame family"). A certain size of block 300, the "small frame block", can be sized to properly fit firearms into the small frame family. Similarly, a different size block, the "large frame block" can be sized to properly fit the large frame family. A large frame block is too large to fit into the magazine well of a small frame family firearm. A small frame block can fit loosely into the magazine well of a large frame family firearm, might engage the magazine release, but is too small to properly fit. Here, "properly fit" means fitting as well as a magazine designed for proper operation with a firearm.

Different embodiments of the block 300 are sized and configured for different firearm families and models. The "1911" family refers to the plethora of different models produced by numerous manufactures based on the Colt 1911 and having many interchangeable parts, particularly the magazine. The same size block can be used for the various 1911 family members, regardless of manufacturer, because they have interchangeable magazines. In contrast, the Smith & Wesson M&P series includes handguns, all produced by the same manufacturer, having different differently sized magazines and therefor also requiring differently sized blocks. The embodiments disclosed herein include blocks for use with firearms, particularly semiautomatic handguns, produced by Glock, STI pistols, Colt, Smith & Wesson, SIG, FN, Beretta, Kel-Tec, Taurus, HK, and others.

The well engagement 301 may be longer than the magazine well 201 into which the block properly fits. This is similar to the various length magazines, including extended magazines, which can be used with various firearm models.

The top ramp 303 can be angled such that it is parallel to the top of the frame 102 or slide rails. Many embodiments have a top ramp 303 sized to prevent small parts from falling between the block 300 and magazine well 201. Here, it is understood that "small parts" refers to the smaller springs, bolts, and other parts from which a firearm is assembled. The block 300 illustrated in FIG. 3 has a beveled area 307. The block 300 has a beveled area 307 because it is intended for a particular firearm family and because certain magazines for that family have a similar structure. The beveled area 307 is therefore an example of configuring the block 300 for a particular model or family of firearm.

The notch 305, as with the notch in a properly sized magazine, can engage a firearm's magazine release 103 to thereby hold the firearm 100 on the block 300.

A mold artifact 304 is shown in the figures. The mold artifact 304 is present because the block 300 is a molded plastic block. Molded plastic parts typically have mold artifacts at the seams between mold halves or at the locations where plastic enters the mold cavity. The mold artifacts typically do not mimic elements of a firearm magazine.

The block 300 can be held in place by the tongue 302. For example, the tongue 302 can be clamped in a vise. The tongue 302 can be screwed to a wooden bench by feeding wood screws through the block mounting holes 306 and screwing the wood screws into the bench. The tongue 302 can be bolted to a fixture by bolts passing through the block mounting holes 306. A solidly mounted block provides a solid firearm holder for firearms having properly fitting magazine wells.

Figure 4:
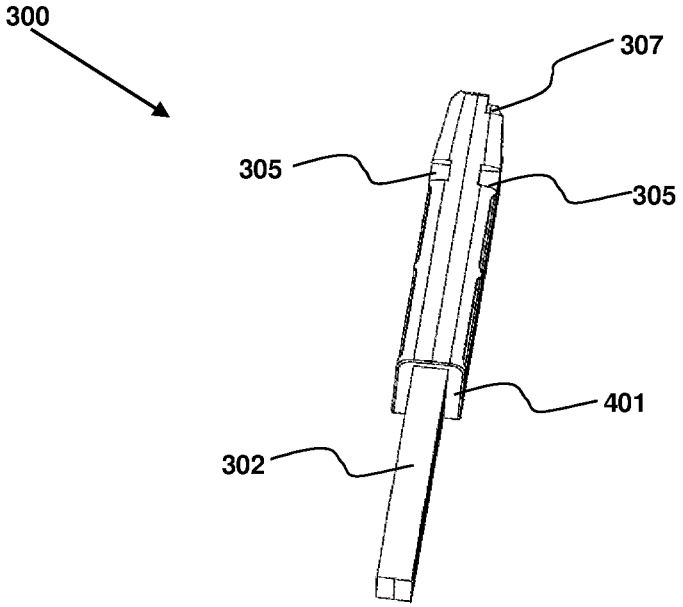
FIG. 4 illustrates the block of FIG. 3 from a different angle in accordance with aspects of the embodiments.

FIG. 4 illustrates the block of FIG. 3 from a different angle. Two notches 305 can be seen. Two notches 305 allows the same block to properly fit and hold firearms having a left side magazine release 103 and those having a right side magazine release. It is not unusual for a firearm family to have left side magazine release models and right side magazine release models. Some firearm models are designed such that the magazine release 103 can be moved to accommodate right handed and left handed shooters. The two notch arrangement, as shown, can accommodate the differently positioned magazine releases. Embodiments having a single notch are likely to be useful for a smaller number of firearms.

The lower flat 401 can be an alignment surface when the lower flat 104 is parallel to the top ramp 303, to the rail slides, or to top surface of the frame 102 or receiver. Here, parallel to the rail slides means parallel when the block 300 is proper installed in a firearm 100. Similarly, parallel to the top of the frame 102 or receiver means parallel when properly installed in a firearm. As such, the design of the lower flat depends on the angle between the magazine well 201 and the slide rails or frame top. Mounting the block such that the lower flat 401 is horizontal can thereby ensure that a firearm is held with horizontal slide rails/frame top when the firearm is properly installed on the block.

Figure 5:
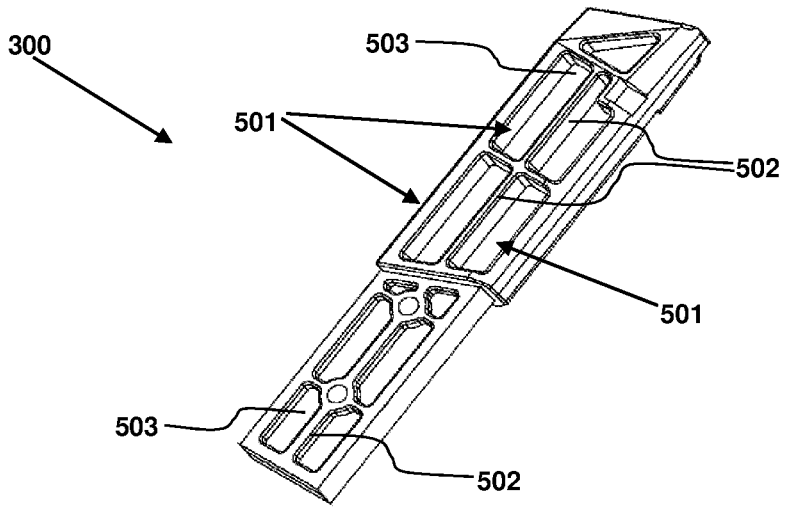
FIG. 5 illustrates the block of FIG. 3 from a different angle in accordance with aspects of the embodiments.
Figure 6:
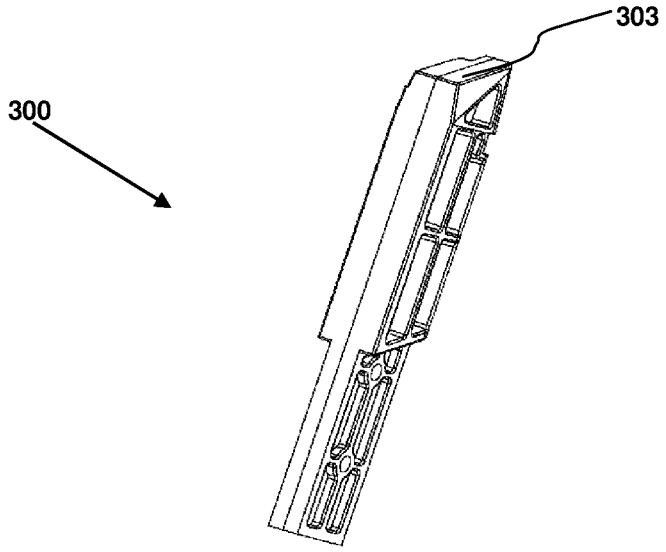
FIG. 6 illustrates the block of FIG. 3 from a different angle in accordance with aspects of the embodiments.

FIGS. 5 and 6 illustrate the block of FIG. 3 from different angles. Here, attention is drawn to cavities 501 in the sides of the block 300. The cavities 501 allow for the block 300 to be formed from a smaller amount of material than a block having no cavities. The cavities 501 are sized to preserve the block's rigidity and the block's strength. Walls 502 between the cavities 501 can add strength and rigidity. The illustrated embodiment has cavities 501 with cavity bottoms 503 such that the cavities do not pass completely through the block 300. The cavity bottoms 503 are similar to the walls excepting that the cavity bottoms 503 separate cavities 501 on either side of the block 300. As illustrated, the well engagement 301 has five cavities 501 on each side; all separated by walls 502 and having cavity bottoms 503. Embodiments lacking cavity bottoms 503 have cavities 501 passing completely through block 300.

Figure 7:
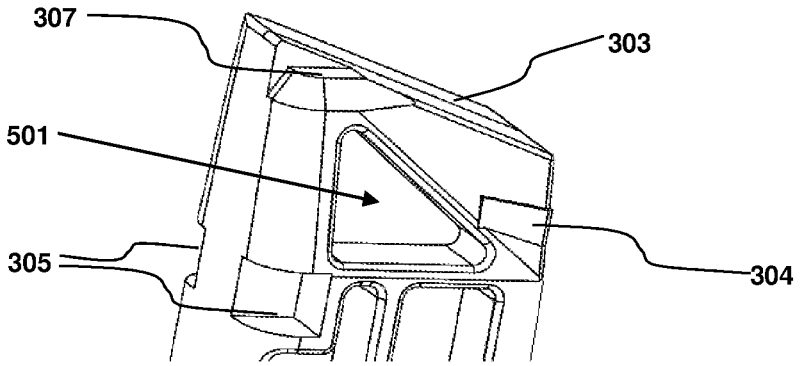
FIG. 7 illustrates the top portion of the block of FIG. 3 in accordance with aspects of the embodiments.
Figure 8:
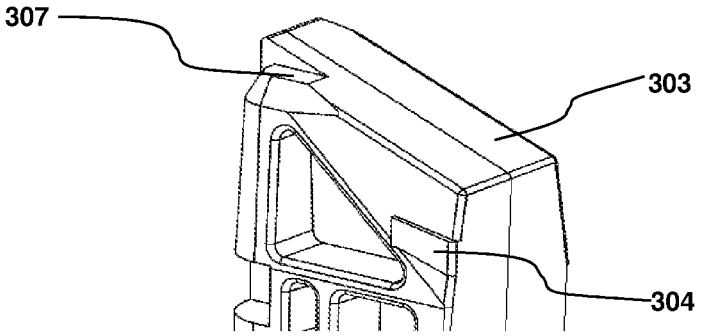
FIG. 8 illustrates the top portion of FIG. 7 from a different angle in accordance with aspects of the embodiments.

FIGS. 7 and 8 illustrate the top portion of the block of FIG. 3 to thereby provide a better view of the notches 305, beveled area 307, mold artifact 304, top ramp 303, and cavity 501.

Figure 9:
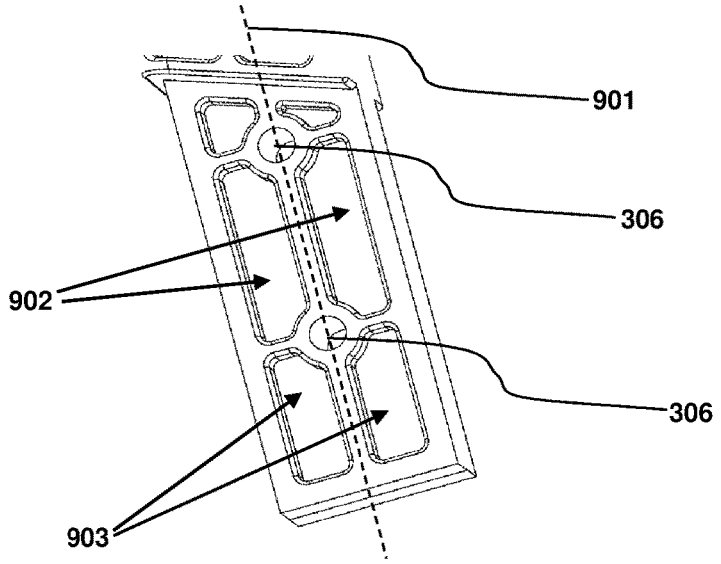
FIG. 9 illustrates the tongue of the block of FIG. 3 in accordance with aspects of the embodiments.

FIG. 9 illustrates the tongue of the block of FIG. 3 to provide a better view of the cavities 902, 903 and mounting holes 306. Note that there are six cavities. The bottom cavities 903 are symmetrical with one another around the centerline 901. The middle cavities 902 are also symmetrical with one another around the centerline 901.

FIGS. 10-13 illustrate a base 1000 from various angles. The base 1000 has a stand 1007 extending up from a base bottom 1006. A slot 1001 passes through the stand 1007 from the top and extending down to or through the base bottom 1006. The base 1000 can be attached to a surface, such as the top of a work bench, using bolts passing through the base holes 1005. In such a case, the base bottom 1006 can lie flat against the top of the work bench. Alternatively, an adhesive, hook and loop material, or two sided tape can be used to fix the base bottom 1006 to a surface. The tongue 302 of a block 300 can be slid into the slot 1001 of the base 1000 such that the block 300 is securely held excepting that the block 300 can slide up and out of the base 1000. A block 300 can be prevented from sliding completely through the base 1000 because the well engagement 302 cannot slide into the slot 1001. Pins or bolts passing through the mounting holes 1002 of the base and the block mounting holes 306 of the block 300 can prevent the block 300 from sliding free. In this manner, differently sized blocks for differently sized firearms can be easily installed in or removed from the base 1000. For example, an armorer can install a small frame block and use it to hold a small frame family firearm. The armorer can then replace the small frame block with a large frame block to thereby hold a large frame family firearm. The tongues of the two blocks must be sized to properly fit the slot and the mounting holes of both blocks should align with the mounting holes 1002 of the base 1000. Note that some embodiments can have blocks with a single mounting hole. Referring to the illustrated embodiments, height adjustment can be achieved by aligning the top mounting holes in the base with the bottom mounting holes of the block before pinning them in place. Alternatively, bases and blocks with a plurality of mounting holes (e.g. four in base, four in block) can provide a variety of height adjustments.

Long ribs 1003 and side ribs 1004 provide strength to the base 1000 such that it is harder to torque the block 300 and thereby bend the base 1000. As illustrated, there are two long ribs and four short ribs.

Figure 10:
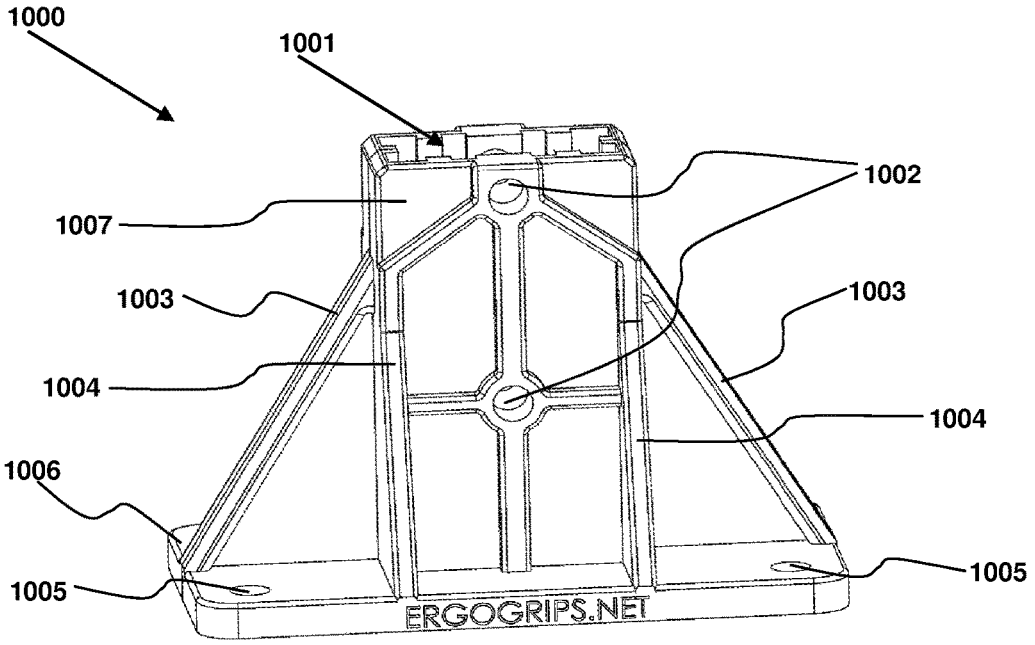
FIG. 10 illustrates a base in accordance with aspects of the embodiments.
Figure 11:
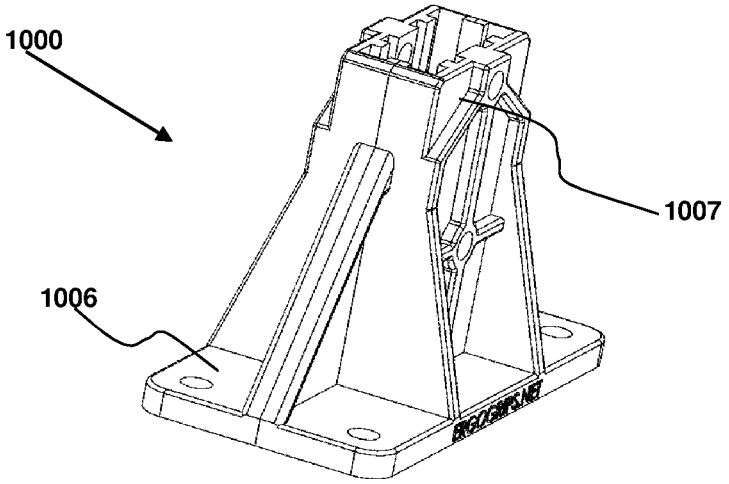
FIG. 11 illustrates the base of FIG. 10 from a different angle in accordance with aspects of the embodiments.
Figure 12:
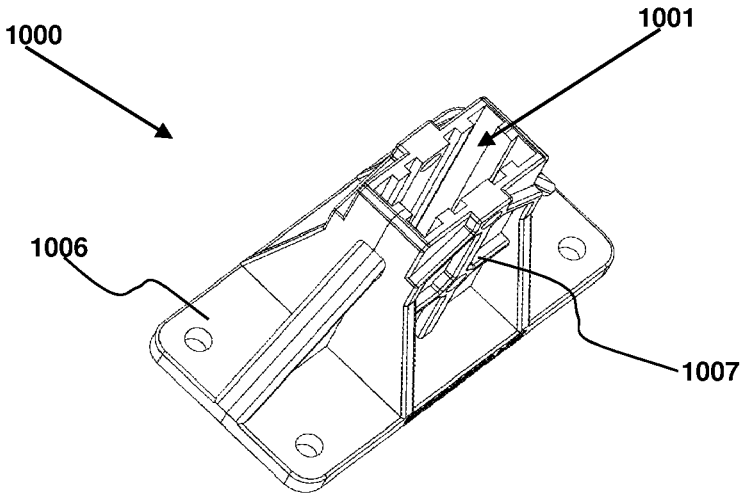
FIG. 12 illustrates the base of FIG. 10 from a different angle in accordance with aspects of the embodiments.
Figure 13:
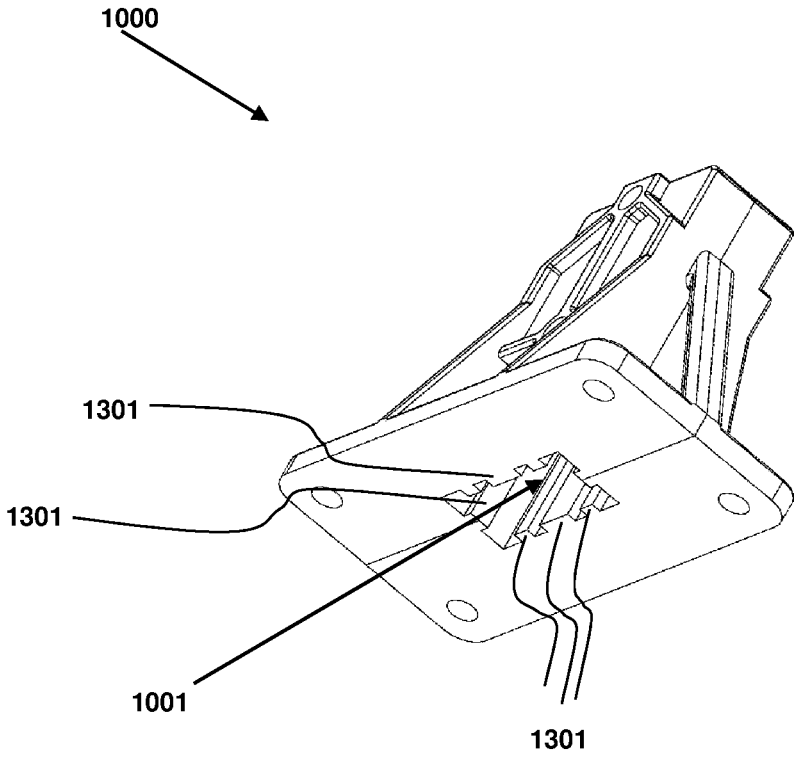
FIG. 13 illustrates the base of FIG. 10 from a different angle in accordance with aspects of the embodiments.

FIG. 13 illustrates the base of FIG. 10 from a different angle. In this embodiment, the slot extends the entire height of the base such that its cross section can be seen on the bottom of the base. Other embodiments have slot that does not extend through the bottom of the base. The illustrated embodiment has slot with a plurality of slot ribs. Each short slot edge has a single rib while each long slot edge has three ribs. Different embodiments can have different numbers of ribs or no ribs, as long as the tongue slides into and through the slot and the block is held firmly once installed.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for holding a frame of a semiautomatic firearm, the frame comprising a magazine well and a magazine release, and the system comprising:

a block comprising a top ramp, a well engagement, a notch, a tongue, and a lower flat, wherein the top ramp is at a top of the well engagement, wherein the lower flat is at a bottom of the well engagement, wherein the tongue is below the well engagement, wherein the well engagement and notch are configured and sized to slide into the magazine well and to releasably engage the magazine release such that the frame is secured to the block;

a base comprising a base bottom, a stand, and a slot, wherein the stand extends up from the base, wherein the slot runs through the base from top to bottom, wherein the slot comprises a plurality of ribs, wherein the slot and ribs are sized and configured such that the tongue slides into the slot and the magazine engagement does not slide into the slot.

2. The system of claim 1 further comprising a second block for holding a second frame of a second semiautomatic firearm, wherein the second frame comprises a second magazine well and second magazine release, wherein the second block comprises a second well engagement, second notch, and second tongue, wherein the second well engagement and second notch are sized and configured to slide into the second magazine well and to releasably engage the second magazine release such that the second frame is secured to the second block, wherein the second block cannot slide into the magazine well, and wherein the second tongue is sized and configured to slide into the slot of the base.

3. A system for holding the frame of a firearm, the frame comprising a magazine well, and the system comprising:

a block comprising a well engagement, a tongue, a block mounting hole, and a lower flat, wherein the lower flat is at a bottom of the well engagement, wherein the tongue is below the well engagement, wherein the well engagement is configured and sized to slide into the magazine well;

a base comprising a base bottom, a stand, a mounting hole and a slot, wherein the stand extends up from the base, wherein the slot runs through the base from top to bottom, wherein the slot is sized and configured such that the tongue slides into the slot, such that the magazine engagement does not slide into the slot, and such that a pin can pass through the block mounting hole and the mounting hole to thereby fix the base to the block.

4. The system of claim 3 wherein the block is plastic and comprises at least one mold artifact.

5. The system of claim 3 wherein the frame further comprises a slide rail, wherein the block further comprises a top ramp located at the top of the well engagement, and wherein the top ramp is parallel to the slide rail.

6. The system of claim 5 wherein the firearm, when assembled, further comprises a plurality of small parts, and wherein the top ramp is sized and configured to prevent the small parts from falling between the well engagement and the magazine well.

7. The system of claim 3 wherein the frame further comprises a top, wherein the block further comprises a top ramp located at the top of the well engagement, and wherein the top ramp is parallel to the top of the frame.

8. The system of claim 3 wherein the frame comprises a magazine release, and wherein the block further comprises a notch configured to releasably engage the magazine release such that the frame is secured to the block.

9. The system of claim 3 wherein the slot comprises a plurality of ribs and wherein the slot and ribs are sized and configured such that the tongue slideably engages the slot.

10. The system of claim 3 wherein the block comprises a plurality of cavities separated by walls and comprising cavity bottoms such that the cavities do not pass completely through the block.

11. The system of claim 3 wherein the magazine release is either a left side magazine release or a right side magazine release, wherein the block comprises two notches, wherein the notch is one of the notches, and wherein the notches are configured such that one of the notches engages the magazine release regardless of the magazine release being a left side magazine release or a right side magazine release.

12. The system of claim 3 wherein the lower flat is parallel to the top ramp.

13. The system of claim 3 wherein the frame further comprises a slide rail and wherein the lower flat is configured to be parallel to the slide rail when the well engagement is in the magazine well.

14. The system of claim 3 wherein the base bottom comprises a plurality of base holes configured for attaching the base to a surface.

15. A method for holding a frame of a firearm, the frame comprising a magazine well, and the method comprising:

sliding the magazine well onto a well engagement wherein a plastic block comprises the well engagement and a tongue; and sliding the tongue into a slot wherein a base comprises the slot, a base bottom, and a stand, wherein the slot runs though the stand, wherein the slot is sized and configured such that the tongue slides into the slot and such that the magazine engagement does not slide into the slot, wherein the stand extends from the base bottom, and wherein the base bottom is configured for attachment to a surface.

16. The method of claim 15 wherein the slot comprises a plurality of ribs and wherein the slot and ribs are sized and configured such that the tongue slideably engages the slot.

17. The method of claim 15 wherein the frame further comprises a slide rail, wherein the block further comprises a top ramp located at the top of the well engagement, and wherein the top ramp is parallel to the slide rail.

18. The method of claim 17 wherein the firearm, when assembled, further comprises a plurality of small parts, and wherein the top ramp is sized and configured to prevent the small parts from falling between the well engagement and the magazine well.

19. The method of claim 18 wherein the frame comprises a magazine release, and wherein the block further comprises a notch configured to releasably engage the magazine release such that the frame is secured to the block.

20. The method of claim 19 wherein the block comprises a plurality of cavities separated by walls and comprising cavity bottoms such that the cavities do not pass completely through the block.

* * * * *